US010718592B1

(12) United States Patent
Wheeler

(10) Patent No.: US 10,718,592 B1
(45) **Date of Patent: *Jul. 21, 2020**

(54) FIREARM SIGHT SYSTEM

(71) Applicant: WM C Anderson INC, Hebron, KY (US)

(72) Inventor: David Edmon Wheeler, Burlington, KY (US)

(73) Assignee: WM C ANDERSON INC, Hebron, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/675,679

(22) Filed: Nov. 6, 2019

Related U.S. Application Data

(63) Continuation-in-part of application No. 16/247,738, filed on Jan. 15, 2019.

(60) Provisional application No. 62/619,855, filed on Jan. 21, 2018.

(51) Int. Cl.
*F41G 1/16* (2006.01)
*F41G 1/08* (2006.01)

(52) U.S. Cl.
CPC ..... *F41G 1/16* (2013.01); *F41G 1/08* (2013.01)

(58) Field of Classification Search
CPC ..... F41G 1/16; F41G 1/08
See application file for complete search history.

(56) References Cited

U.S. PATENT DOCUMENTS

| | | | | |
|---|---|---|---|---|
| 5,533,292 | A * | 7/1996 | Swan | F41G 1/16 42/123 |
| 5,590,484 | A * | 1/1997 | Mooney | F41G 1/16 42/111 |
| 7,356,962 | B2 * | 4/2008 | Swan | F41G 1/065 42/133 |
| 8,104,218 | B2 * | 1/2012 | McCann | F41G 1/033 42/111 |
| 2003/0127085 | A1 * | 7/2003 | Brunette | F41B 11/55 124/74 |
| 2010/0037505 | A1 * | 2/2010 | Romer | F41C 27/00 42/124 |
| 2012/0102803 | A1 * | 5/2012 | Troy | F41C 23/16 42/71.01 |
| 2016/0209166 | A1 * | 7/2016 | Larson, Jr. | F41G 11/003 |
| 2019/0017784 | A1 * | 1/2019 | Smith | F41G 1/08 |

* cited by examiner

*Primary Examiner* — Gabriel J. Klein
(74) *Attorney, Agent, or Firm* — Bennet K. Langlotz; Langlotz, Patent & Trademark Works, LLC

(57) ABSTRACT

Firearm sight systems have an elongated mounting rail including a plurality of transverse bars separated by intervening transverse mounting location channels extending from a rearmost channel to a forwardmost channel, the rail having an elongated upper surface, the rail defining a pocket below the upper surface and at least in part forward of the rearmost channel, and a sight arm pivotally connected to the rail and movable between an elevated position angularly offset from the upper surface of the rail and a stowed position in which the sight arm occupies the pocket. At least a forward portion of the sight arm may be entirely below the upper surface of the rail when in the stowed position. The entire sight arm may be entirely below the upper surface of the rail when in the stowed position. The sight arm may pivot on a pivot axis below the upper surface of the rail.

24 Claims, 10 Drawing Sheets

FIREARM SIGHT SYSTEM

CROSS-REFERENCE TO RELATED APPLICATION

This application is a Continuation-in-Part of U.S. patent application Ser. No. 16/247,738 filed on Jan. 15, 2019, entitled "IFS-R (INTEGRATED FLIP-UP SIGHT-REAR) SYSTEM, AR-15/10 AND M16/M4 VARIANTS AND OTHERS," which claims the benefit of U.S. Provisional Patent Application No. 62/619,855 filed on Jan. 21, 2018, entitled "IFS-R (Integrated Flip-Up Sight-Rear) System, AR-15/10 and M16/M4 Variant and Others," which are hereby incorporated by reference in their entirety for all that is taught and disclosed therein.

FIELD OF THE INVENTION

The present invention relates to firearms, and more particularly to a firearm sight system that provides an integrated flip-up rear sight for AR-15/10 and M16/M4 rifle variants.

BACKGROUND OF THE INVENTION

The modern AR-15 style rifle platform is primarily comprised of MIL-SPEC (Military Specification) components originally derived from the M16A1/A2, M4A1 and M16A4 variants. Platforms include semi-automatic, burst and full-automatic fire control versions, as well as a multitude of caliber configurations. Most modern AR-15 components have retained either MIL-SPEC adherence and/or a close resemblance to the original 1956 Eugene Stoner and L. James Sullivan Armalite AR-15 design. All M16A1/A2, M4A1 and M16A4 variants retain absolute adherence to MIL-SPEC requirements, as these platforms are intended for applications in standardized military service.

The MIL-SPEC design utilizes an integrated Rear Sight, commonly referred to as an "Iron Sight." Although the M4 variant is an exception, as it provides a Picatinny rail (MIL-STD-1913) for the mounting of its sight/optical aid. This type of configuration is commonly referred to as "Optic Ready," inferring that a sight or optical device must first be installed on the firearm for accurate target acquisition. With the advent of the M4 configuration and further popularization of Upper Receiver designs without an integrated rear sight, a typical approach to provide sighting capabilities followed suit with the M4 application by utilizing Picatinny rail-mounted devices. Consequently, there are now a multitude of sight/optical aid devices available; several of which mimic the original carrying handle with integrated sight style.

The most common and relatively economical solution to an Optic Ready firearm is the flip-up style sight. However, this design is rather impractical, as it often requires the use of a special tool, such as a hex driver, screwdriver, Torx® driver, etc. to mount, adjust or uninstall on the Picatinny rail. Furthermore, many of these devices are attached to the Picatinny rail by a single fastener, screw or bolt, and are consequently susceptible to loosening during use and the subsequent loss of sight calibration or zero; thus, creating the added burden of always having to carry a special tool for this purpose, which could prove to be especially burdensome in a tactical environment.

Moreover, the deviation of reliance upon Iron Sights to an electronic optical device, which can illuminate reticles, provide electronic magnification and/or thermal imaging, tends to produce an undesired dependence, thus effecting a considerable tactical disadvantage as these optics require a constant, replenishing source of power (i.e. batteries, power cells, etc.). However, once a source of power is no longer readily available, the device would be rendered inoperable, causing conditions to rapidly deteriorate.

Additionally, while many configurations of the flip-up type sight utilize a locking mechanism, which must be pressed or released to permit folding, they are typically not impact resistant once positioned into the flip-up orientation, making them susceptible to strike or impact damage.

Another problematic condition of prior art flip-up style sights is a deviation from the original MIL-SPEC sight centerline to the bore centerline. Because most rear flip-up style sights do not provide elevation adjustment or compensation, this condition can exceed the vertical adjustment travel (+/−) of the front sight post. As such, optics that are installed between flip-up sights can further compound this condition when original MIL-SPEC centerlines are not maintained.

Therefore, a need exists for a new and improved firearm sight system that an integrated flip-up rear sight for AR-15/10 and M16/M4 rifle variants. In this regard, the various embodiments of the present invention substantially fulfill at least some of these needs. In this respect, the firearm sight system according to the present invention substantially departs from the conventional concepts and designs of the prior art, and in doing so provides an apparatus primarily developed for the purpose of providing an integrated flip-up rear sight for AR-15/10 and M16/M4 rifle variants.

SUMMARY OF THE INVENTION

The present invention provides an improved firearm sight system, and overcomes the above-mentioned disadvantages and drawbacks of the prior art. As such, the general purpose of the present invention, which will be described subsequently in greater detail, is to provide an improved firearm sight system that has all the advantages of the prior art mentioned above.

To attain this, the preferred embodiment of the present invention essentially comprises an elongated mounting rail including a plurality of transverse bars separated by intervening transverse mounting location channels extending from a rearmost channel to a forwardmost channel, the rail having an elongated upper surface, the rail defining a pocket below the upper surface and at least in part forward of the rearmost channel, and a sight arm pivotally connected to the rail and movable between an elevated position angularly offset from the upper surface of the rail and a stowed position in which the sight arm occupies the pocket. At least a forward portion of the sight arm may be entirely below the upper surface of the rail when in the stowed position. The entire sight arm may be entirely below the upper surface of the rail when in the stowed position. The sight arm may pivot on a pivot axis below the upper surface of the rail, and the pivot axis may be forward of the rearmost channel. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
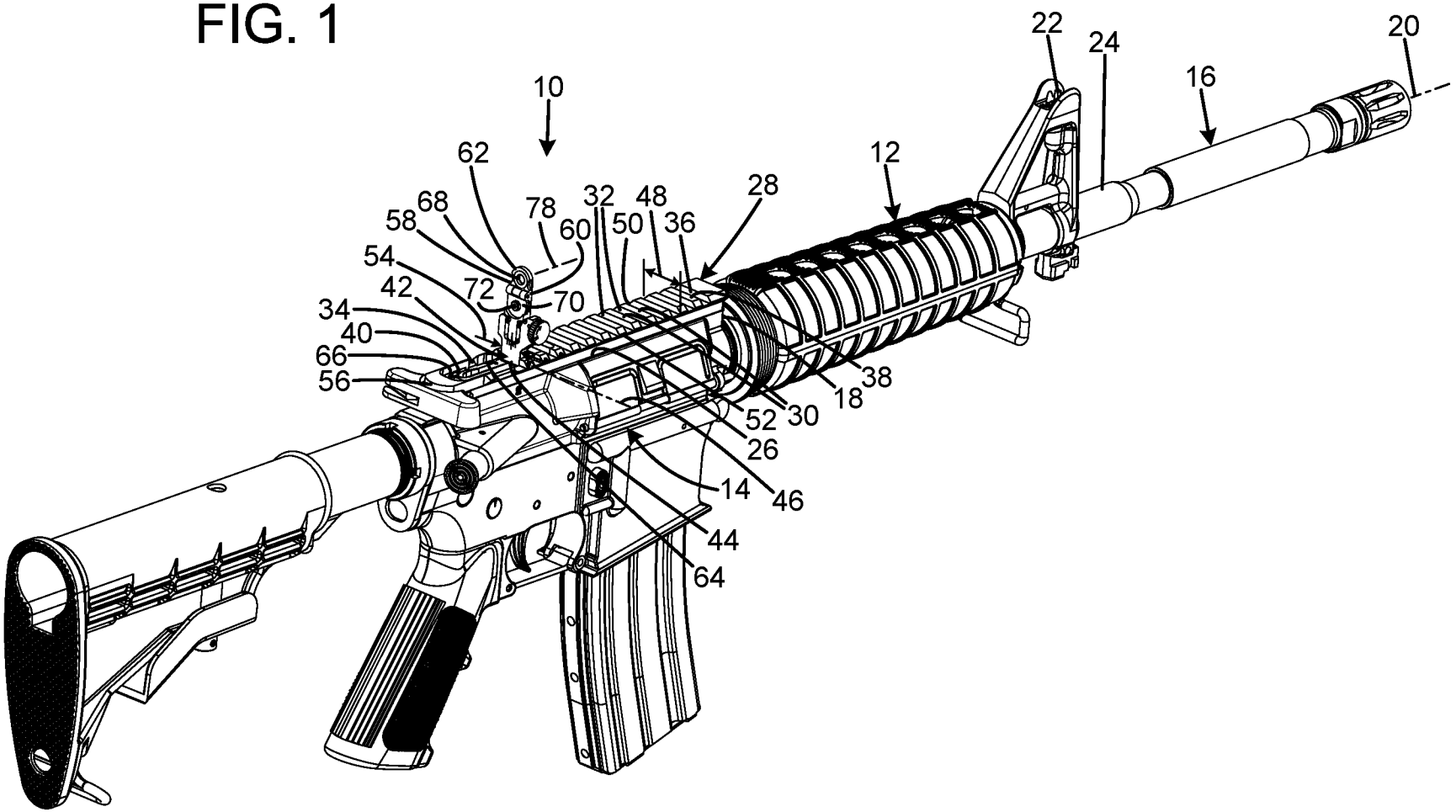
FIG. 1 is a top isometric view of the current embodiment of a firearm sight system constructed in accordance with the principles of the present invention in use attached to a rifle with the firearm sight system in the elevated position.

An embodiment of the firearm sight system of the present invention is shown and generally designated by the reference numeral 10.

Figure 2A:
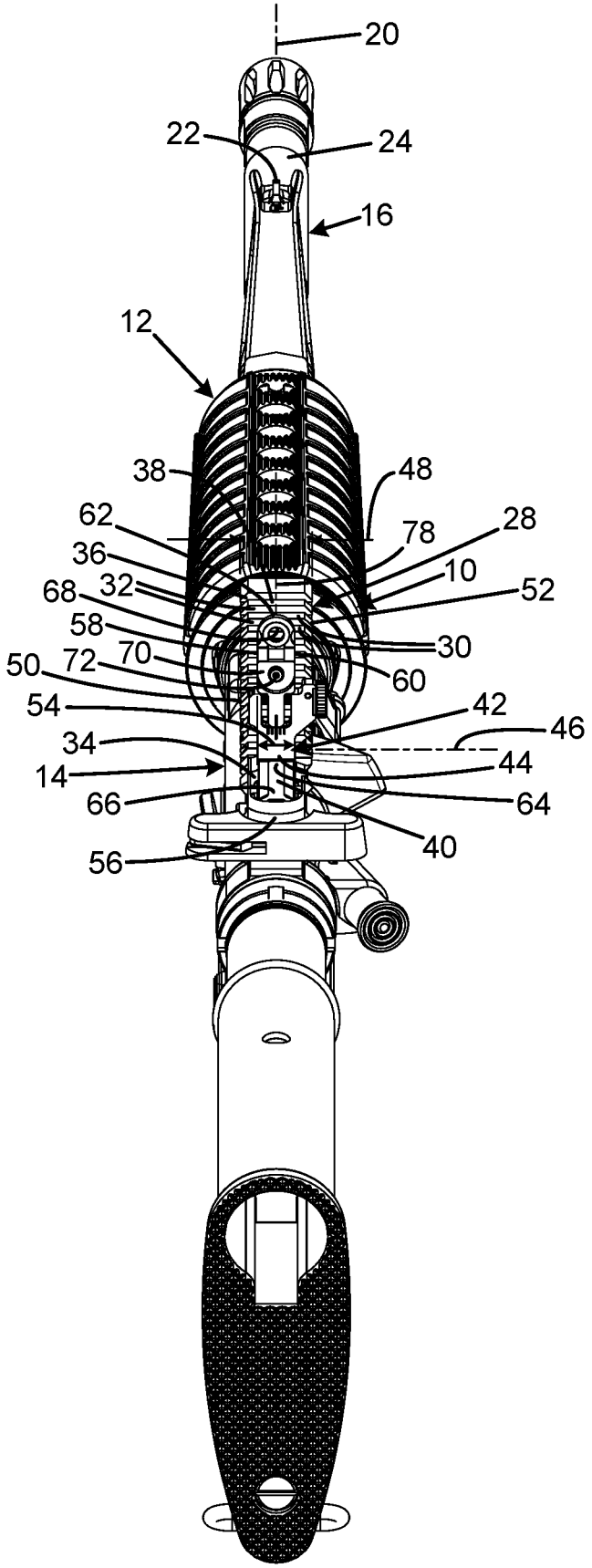
FIG. 2A is a top rear view of the firearm sight system of FIG. 1 attached to a rifle with the firearm sight system in the elevated position.
Figure 2B:
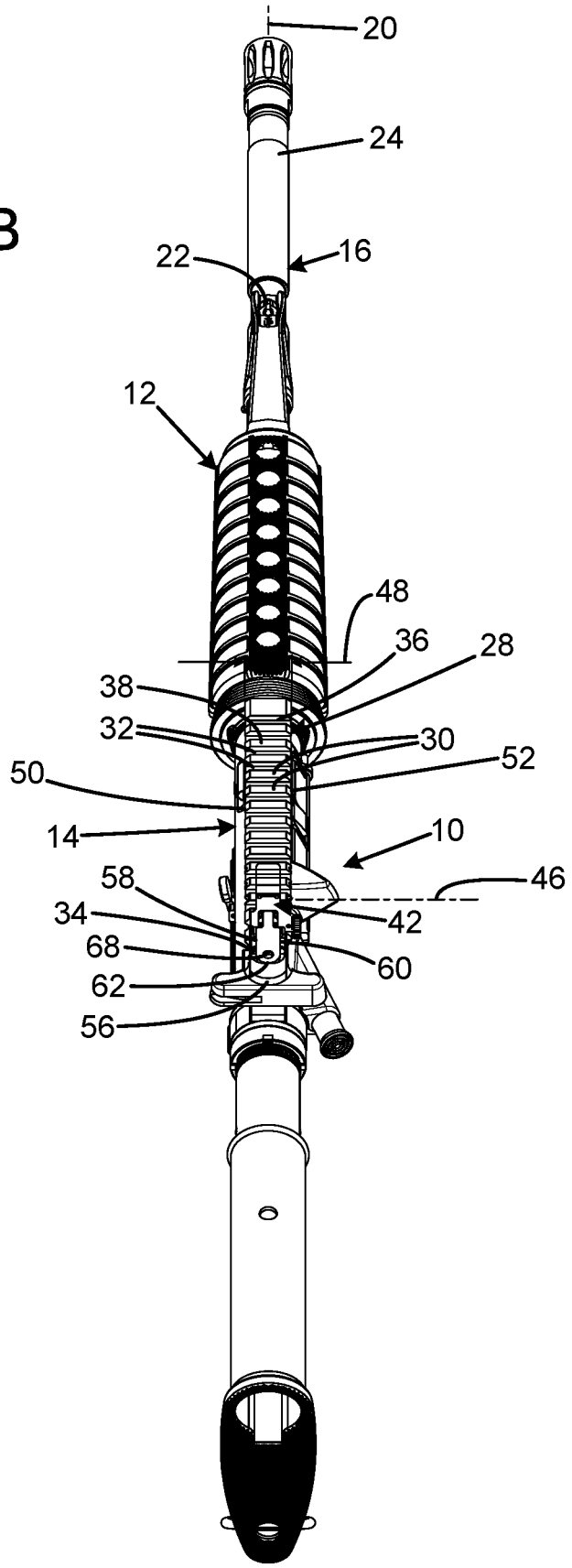
FIG. 2B is a top rear view of the firearm sight system of FIG. 1 attached to a rifle with the firearm sight system in the stowed position.
Figure 3:
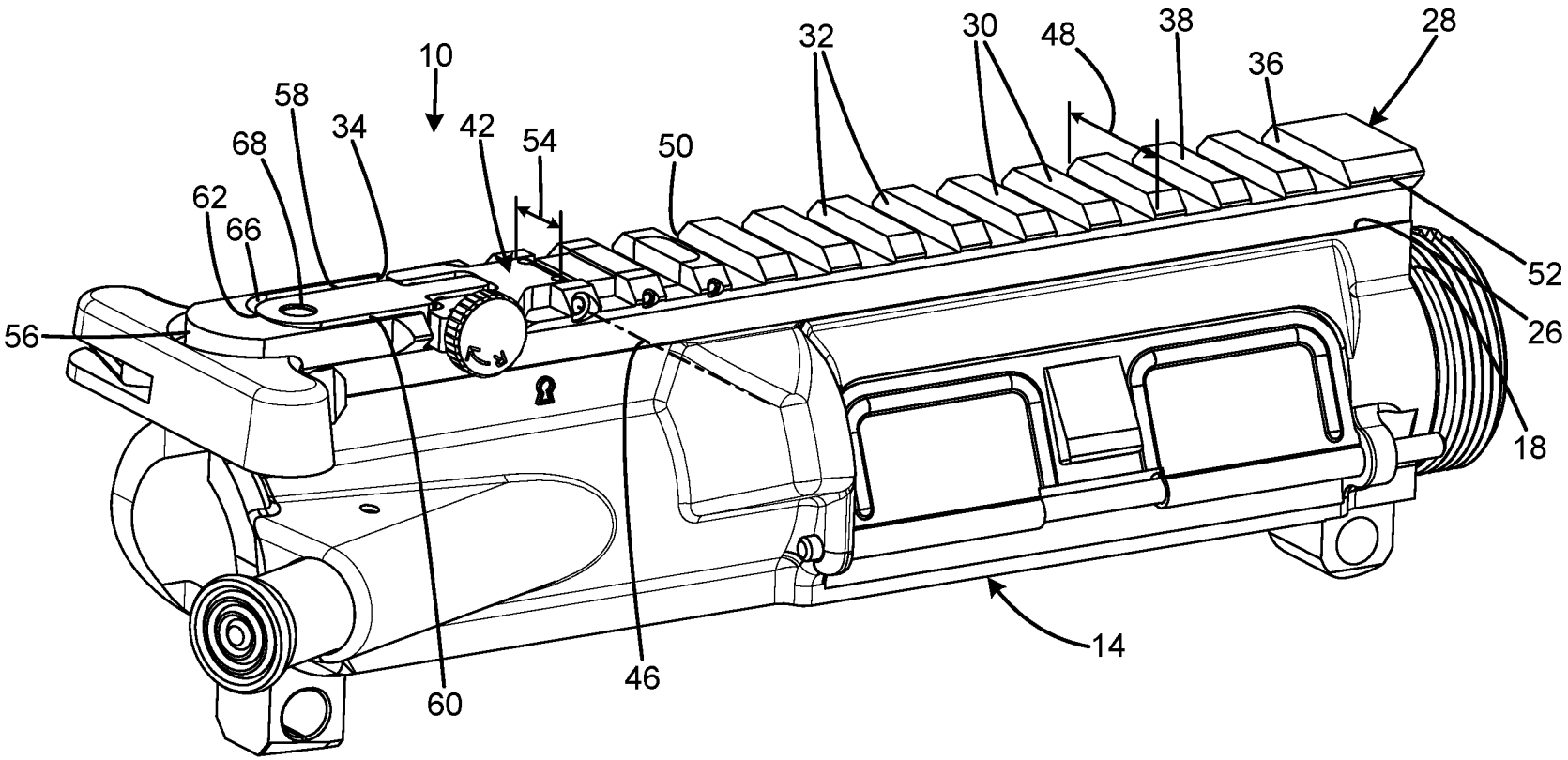
FIG. 3 is a top isometric view of the firearm sight system of FIG. 1 attached to an upper receiver with the firearm sight system in the stowed position.

FIGS. 1-3 illustrate the improved firearm sight system 10 of the present invention. More particularly, FIG. 1 shows the firearm sight system in use in the elevated position attached to a rifle 12, FIGS. 2A & 2B show enlarged views of the firearm sight system in the elevated and stowed positions, and FIG. 3 shows the firearm sight system in the stowed position. The rifle includes a frame/upper receiver 14 with a barrel 16 mounted to the front 18 of the upper receiver. The barrel defines a barrel axis 20. A front sight 22 extends upward from a forward portion 24 of the barrel. The upper receiver has a top 26 that forms an elongated mounting rail 28. The elongated mounting rail includes a plurality of transverse bars 30 separated by intervening transverse mounting location channels 32 extending from a rearmost channel 34 to a forwardmost channel 36. The elongated mounting rail has an elongated upper surface 38. The elongated mounting rail defines a pocket 40 below the upper surface and at least in part forward of the rearmost channel. A sight arm 42 is pivotally connected to the elongated mounting rail and is movable between an elevated position angularly offset from the upper surface of the elongated mounting rail and a stowed position in which the sight arm occupies the pocket.

As can be appreciated in FIGS. 2B & 3, at least a forward portion 44 of the sight arm 42 is entirely below the elongated upper surface 38 of the elongated mounting rail 28 when in the stowed position. In the current embodiment, the entire sight arm is entirely below the elongated upper surface of the elongated mounting rail when in the stowed position. The sight arm pivots on a pivot axis 46 located below the elongated upper surface of the elongated mounting rail. The pivot axis is located forward of the rearmost channel 34. The elongated mounting rail has a rail width 48 defined between opposed left and right lateral rail edges 50, 52. In the current embodiment, the sight arm has an arm width 54 less than the rail width.

In the current embodiment, the entire sight arm 42 is forward of a rear end 56 of the elongated mounting rail 28. The pocket 40 encompasses the left and right sight arm sides 58, 60 and rear 62 when the sight arm is in the stowed position. The pocket defines a forward neck portion 64 having a first width and a rearward head portion 66 having a greater width. The sight arm defines a first sight aperture 68 and includes a pivoting aperture element 70 with a second smaller aperture 72.

In the current embodiment, the pivoting aperture element 70 is movable between a first position in which the second smaller aperture 72 of the pivoting aperture element registers with the first sight aperture 68 to provide a reduce diameter sight, and a second position away from the first sight aperture. The sight arm 42 includes at least one magnet (upper and lower magnetic inserts 74, 76 shown in FIG. 5) to movably secure the pivoting aperture element to the sight arm in at least one of the first and second positions. In the current embodiment, the first sight aperture defines a sight axis 78 when the sight arm is in the elevated position at least 2.5 inches above the barrel axis and preferably 2.6 inches above the barrel axis.

Figure 4:
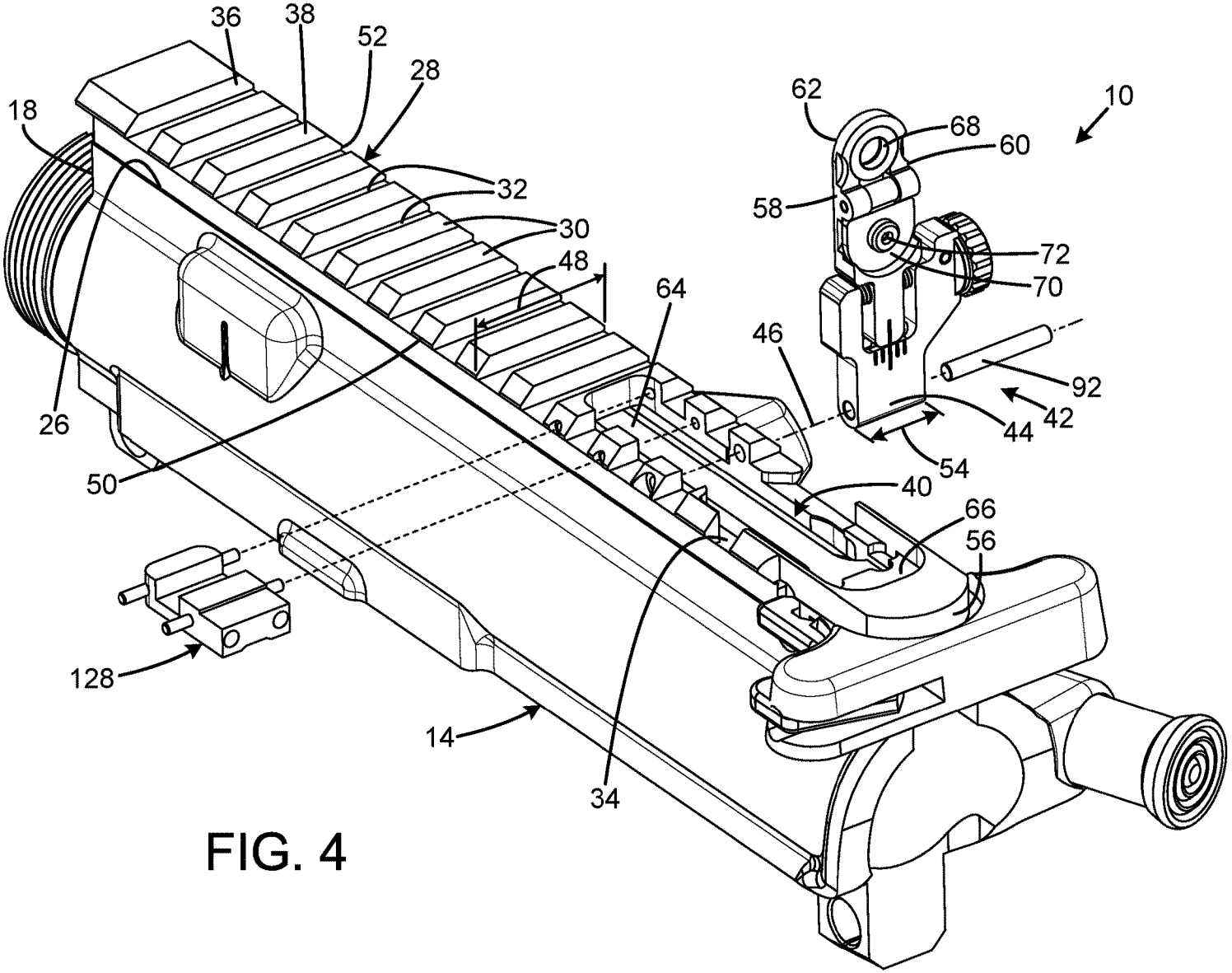
FIG. 4 is an exploded view of the firearm sight system of FIG. 1 with an upper receiver.
Figure 5:
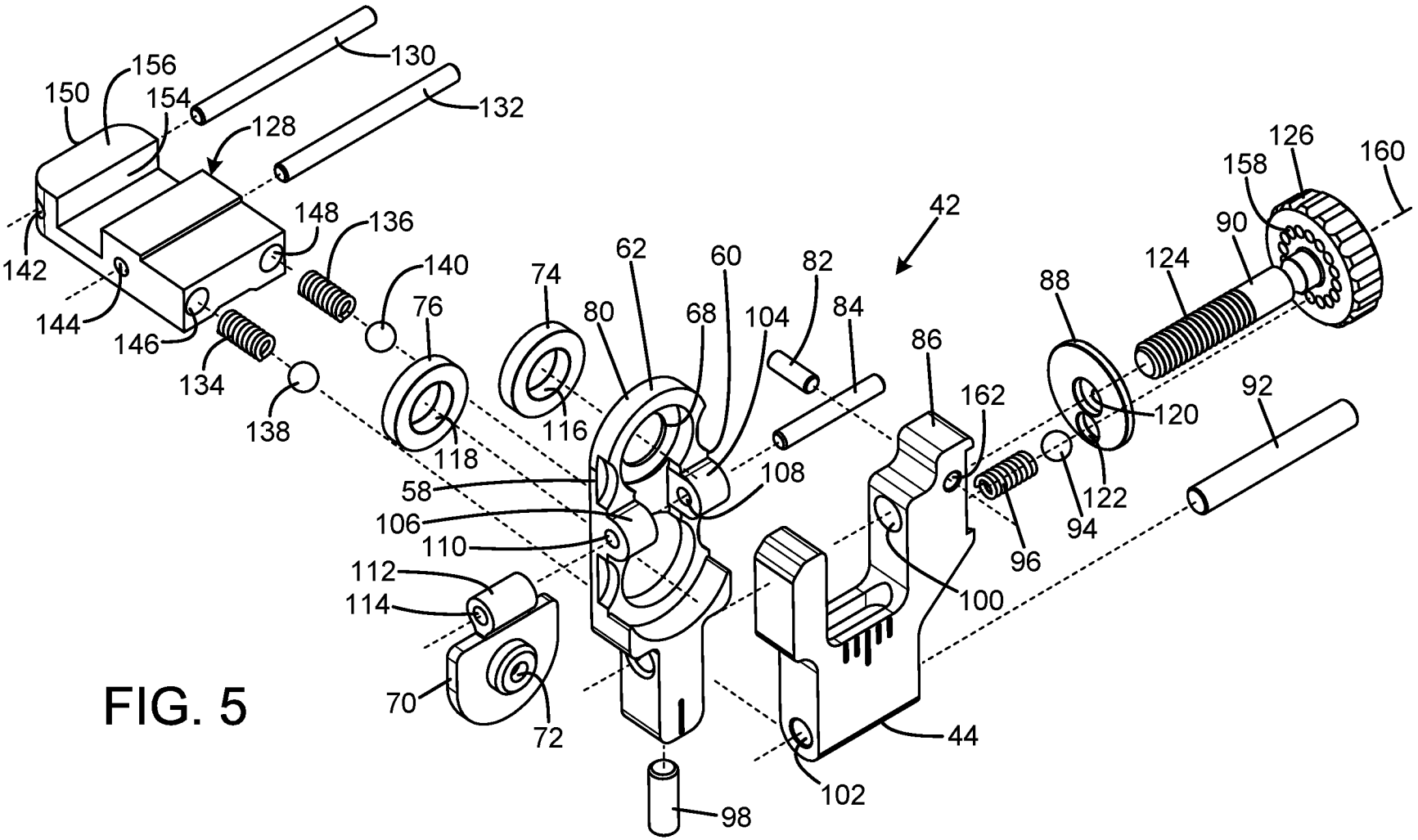
FIG. 5 is an exploded view of the firearm sight system of FIG. 1.

FIGS. 4 & 5 illustrate the improved firearm sight system 10 of the present invention. More particularly, the firearm sight system is shown in exploded views so that all of its components can be appreciated. The sight arm 42 includes a rear sight post 80, a screw lock pin 82, and aperture pivot pin 84, a rear sight base 86, a traverse screw dust cover 88, a traverse screw 90, a base pivot pin 92, a traverse lock detent ball 94, a traverse lock spring 96, a traverse guide pin 98, pivoting aperture element 70, and upper and lower magnetic inserts 74, 76. The rear sight base defines a screw aperture 100 that receives a threaded portion 124 of the traverse screw. The traverse screw also includes a knurled head portion 126 to facilitate rotation of the traverse screw. Traverse adjustment of the firearm sight system is performed by clockwise or counterclockwise rotation of the traverse screw, resulting in left or right movement of the rear sight post. The traverse screw's rotational setting is maintained by sixteen individual positional points 158 located on the underside of the knurled head portion around the screw axis 160. The spring-loaded traverse lock detent ball assembled within the rear sight base engages the appropriate positional point on the traverse screw as the traverse screw is rotated during sight adjustment. The spring-loaded traverse lock detent ball also serves to provide constant spring pressure upon the traverse screw to ensure sight setting integrity upon strike or impact. Under spring protection, the knurled head portion of the traverse screw can be used to elevate the sight arm into the elevated position.

The base pivot pin 92 is received by a pin aperture 102 defined by the forward portion 44 of the rear sight base 86 of the sight arm 42. The rear sight post 80 includes a right ear 104 and a left ear 106. The right ear defines a pin aperture 108, and the left ear defines a pin aperture 110. The aperture pivot pin 84 is received by the pin apertures 108, 110. The pivoting aperture element 70 has a top 112 that defines a pin aperture 114 that also receives the aperture pivot pin. The rear sight base also defines a pin aperture 162 that receives the screw lock pin 82. The upper magnetic insert 74 and the lower magnetic insert 76 each define a central bore 116, 118. The central bore 116 is axially registered with the first sight aperture 68. The traverse screw dust cover 88 defines a central bore 120 and a detent aperture 122 located below the central bore. The central bore receives the threaded portion 124 of the traverse screw 90, and the detent aperture is axially registered with the traverse lock detent ball 94. The detent aperture enables the traverse lock detent ball to protrude through the traverse screw dust cover engage a selected individual positional point 158 located on the underside of the knurled head portion 126 of the traverse screw.

A rear spring block base 128 is releasably secured to the elongated mounting rail 28 on the upper receiver 14 by forward rear spring block pin 130 and rear spring block pin 132. The forward and rear spring block pins are received by selected transverse mounting location channels 32 and by pin apertures 142, 144 defined by the rear spring block base. The rear spring block base has a front 150, rear 152, and a transverse mounting location channel 154 defined by its top 156. The rear of the rear spring block base defines a left bore 146 and a right bore 148. The left bore receives a left rear spring block spring 134 and a left rear spring block detent ball 138. The right bore receives a right rear spring block spring 136 and a right rear spring block detent ball 140.

Figure 6A:
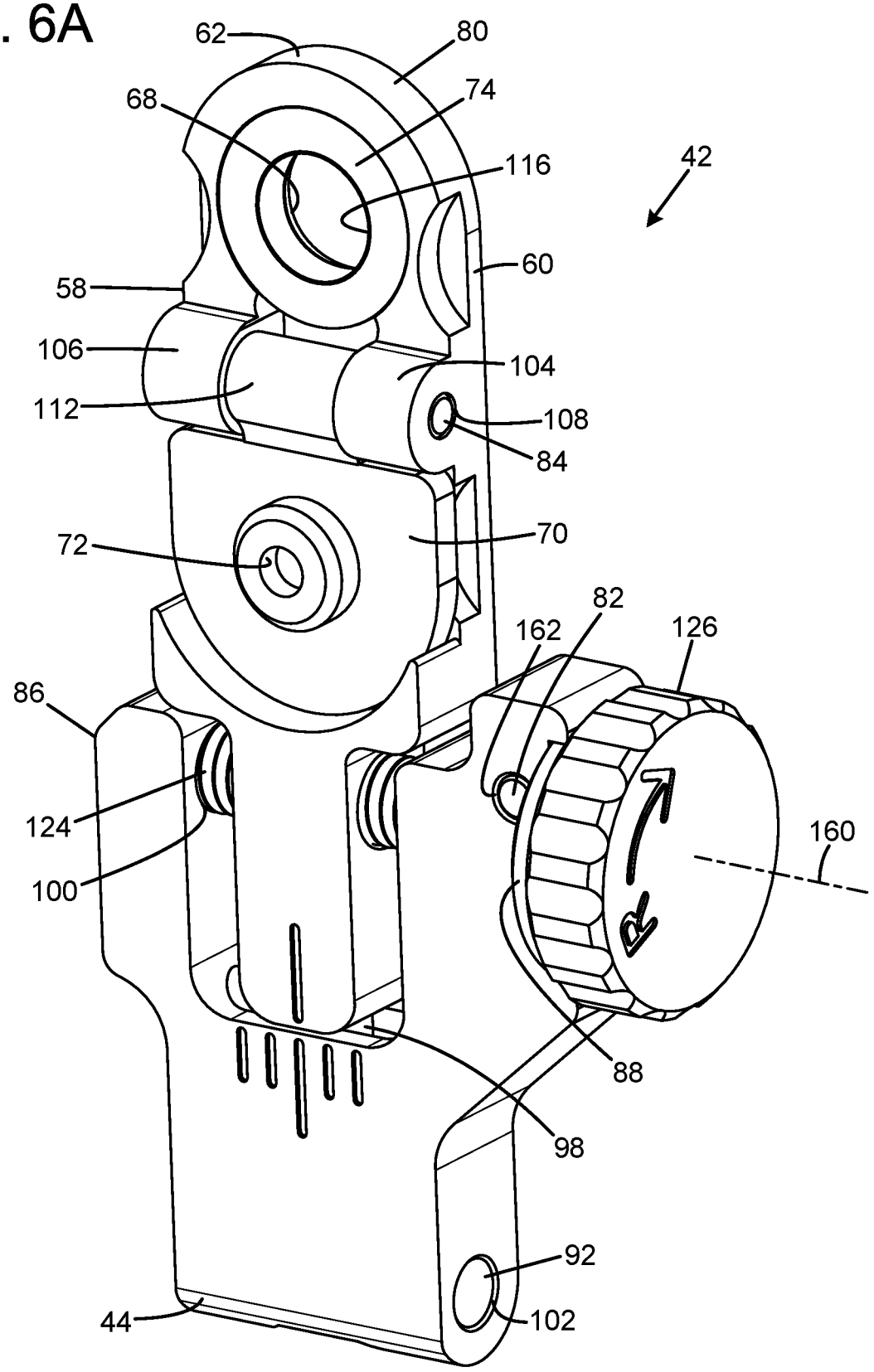
FIG. 6A is a top isometric view of the firearm sight system of FIG. 1 with the pivoting aperture element in the short-range position.
Figure 6B:
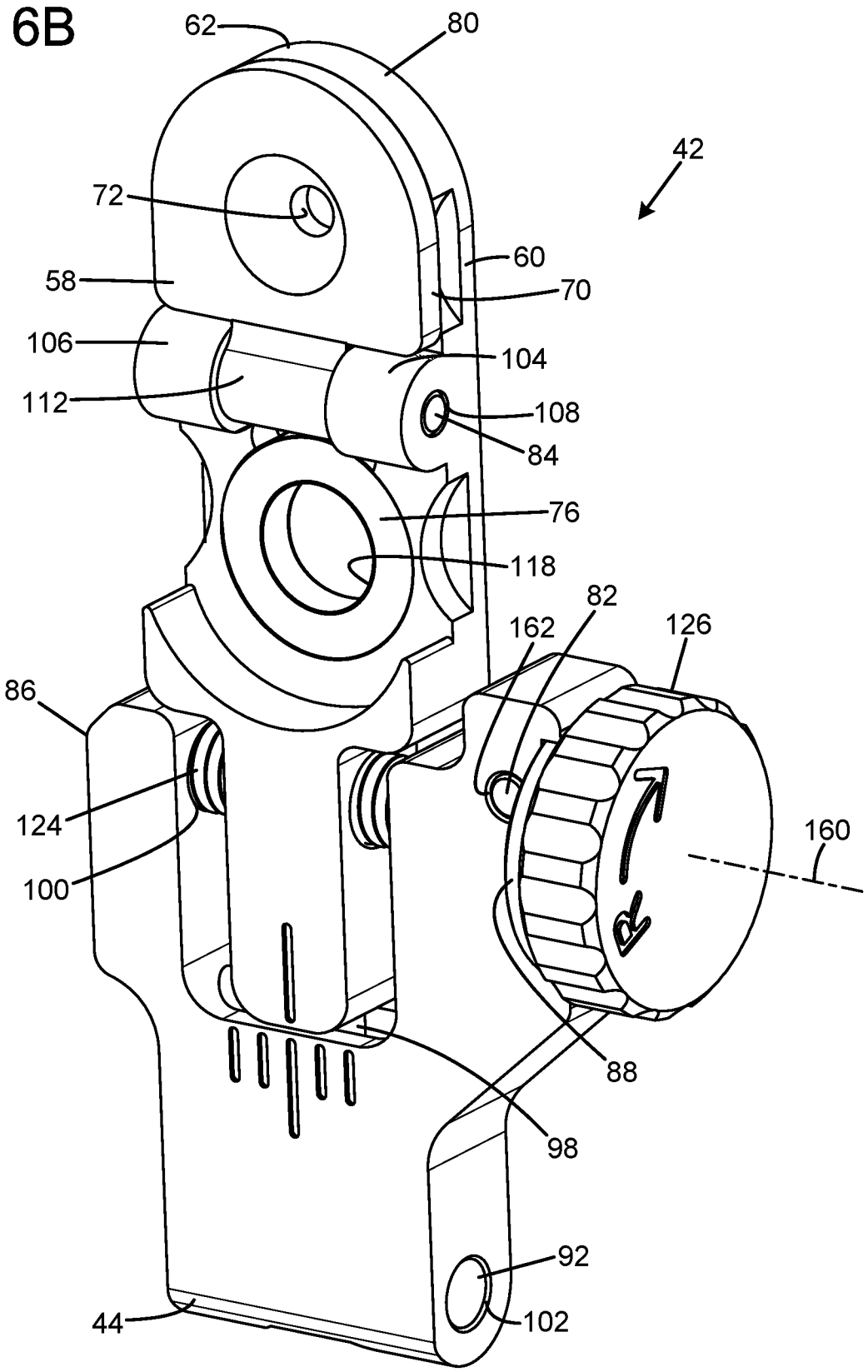
FIG. 6B is a top isometric view of the firearm sight system of FIG. 1 with the pivoting aperture element in the long-range position.
Figure 8:
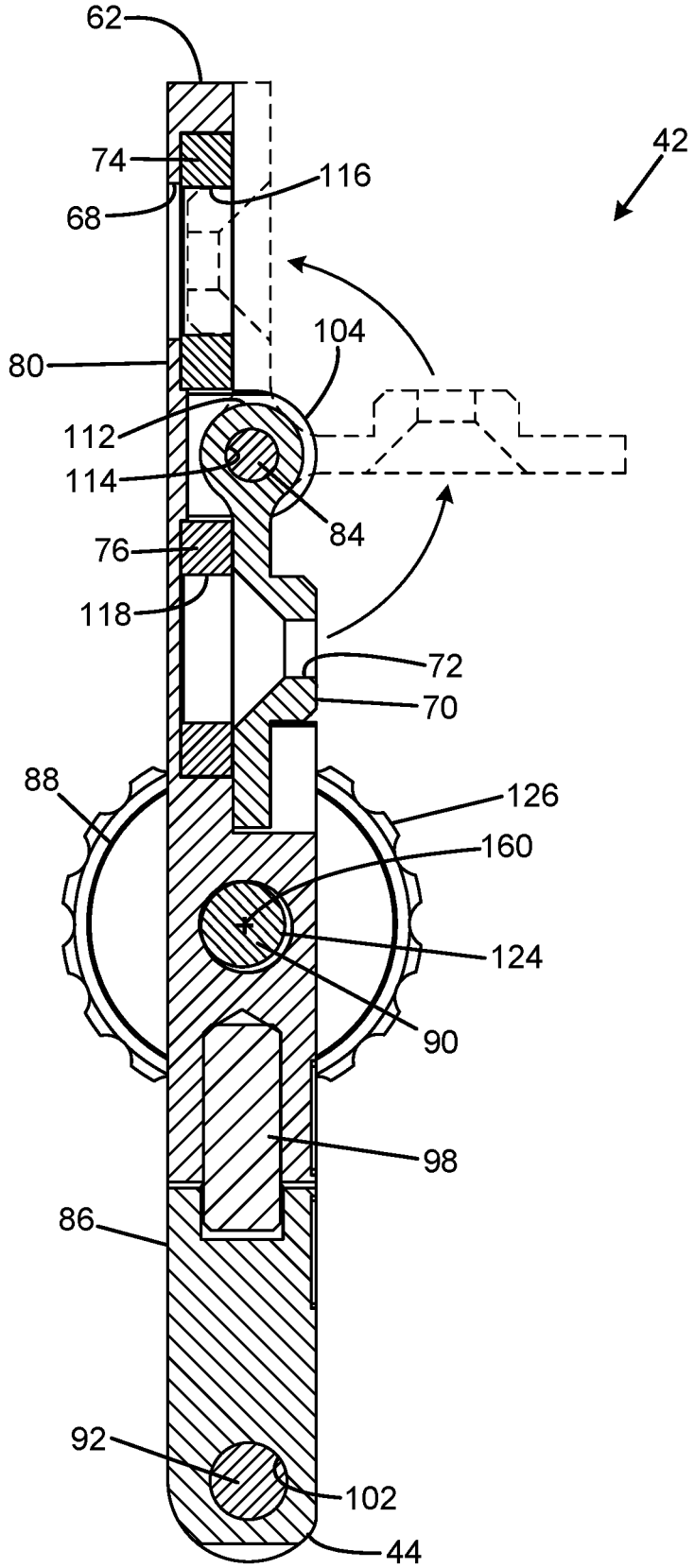
FIG. 8 is a side sectional view of the firearm sight system of FIG. 1 with the pivoting aperture element shown in solid lines in the short-range position and in dashed lines both in transition between the short-range position and the long-range position as well as in the long-range position.

FIGS. 6A, 6B & 8 illustrate the sight arm 42. More particularly, the interaction between the pivoting aperture element 70 and the first sight aperture 68 is depicted. When the pivoting aperture element is in the lower short-range position depicted in FIG. 6A and in the solid lines of FIG. 8, the first sight aperture is unobstructed to provide a maximum diameter ghost ring, center-hold sight picture for short-range engagements at less than 300 m in accordance with MIL-SPEC standards. When the pivoting aperture element is in the upper long-range position depicted in FIG. 6B and in one set of the dashed lines of FIG. 8, the first sight aperture is partially obstructed to provide a smaller diameter ghost ring, center-hold sight picture through the second smaller aperture 72 for long-range engagements at greater than 300 m in accordance with MIL-SPEC standards. The pivoting aperture element transitions between the upper and lower positions, as denoted by a second set of the dashed lines of FIG. 8, by pivoting about pivot axis 46 defined by base pivot pin 92. The pivoting aperture element is made of a suitable material that is attracted to upper and lower magnetic insert 74, 76 so that the pivoting aperture element is releasably retained in both the upper and lower positions. Milled steps are provided on each side of the rear sight post to aid in overcoming the magnetic force exerted by the upper and lower magnetic inserts to lift the pivoting aperture element from either of the upper and lower positions.

Figure 7:
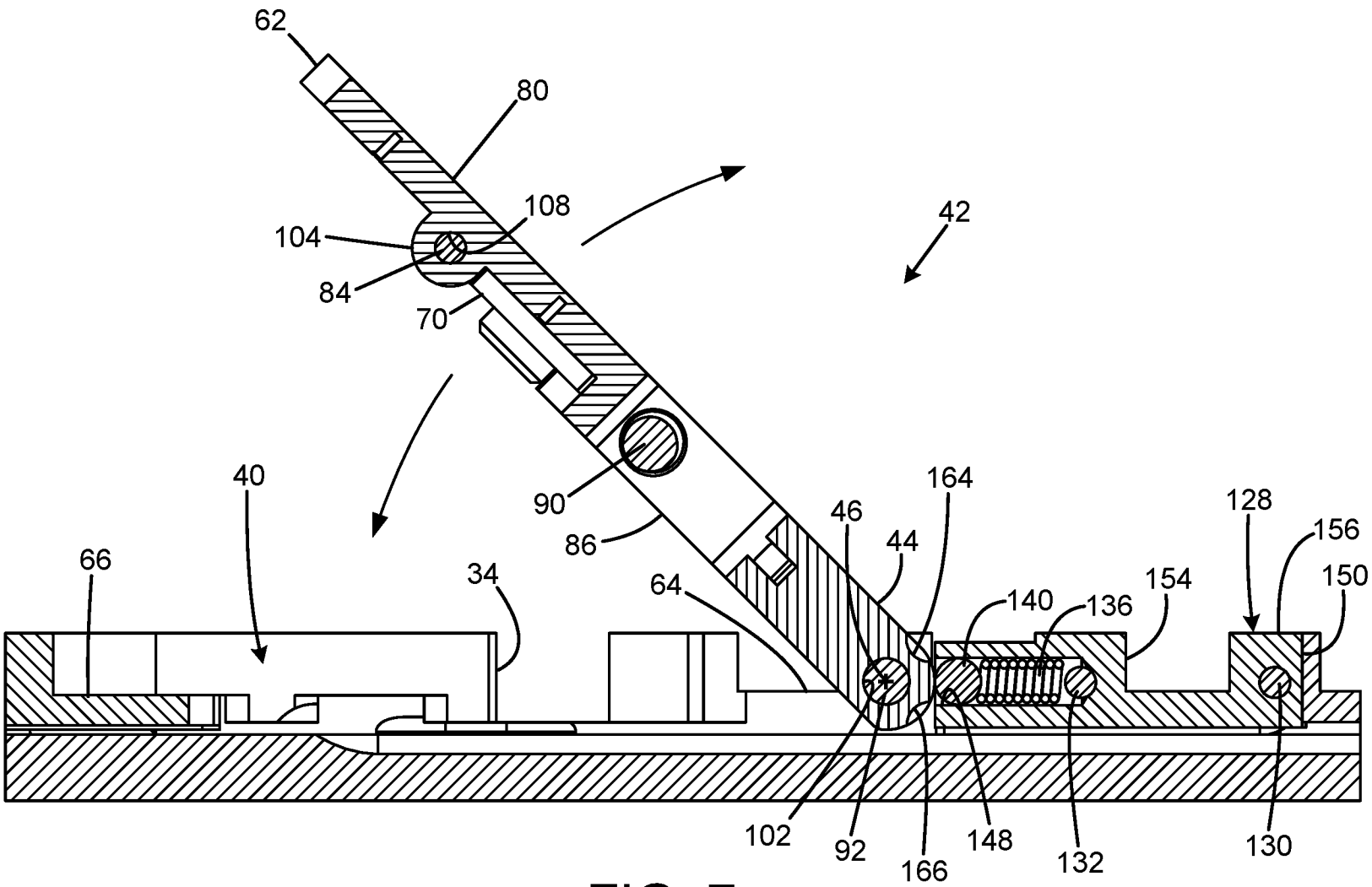
FIG. 7 is a side sectional view of the firearm sight system of FIG. 1 attached to the elongated mounting rail portion of an upper receiver in transition between the elevated position and the stowed position.

FIG. 7 illustrates the sight arm 42. More particularly, the sight arm is shown in transition between the elevated and stowed positions. The forward portion 44 of the rear sight base 86 of the sight arm defines two recesses 164, 166. Folding and unfolding of the sight arm is guided and supported by the left and right spring-loaded rear spring block detent balls 138, 140 located within the left and right bores 146, 148 in the rear 152 of the rear spring block base 128. The left and right rear spring block detent balls orientate and releasably lock the sight arm in the elevated position and releasably hold the sight arm down within the pocket 40 in the stowed position. Travel of the sight arm is inherently limited to 90° about the pivot 46 axis. Releasably securing the sight arm in the elevated position by the left and right rear spring block detent balls also serves to mitigate impact or strike upon the sight arm by simply folding the sight arm to prevent damage.

While a current embodiment of a firearm sight system has been described in detail, it should be apparent that modifications and variations thereto are possible, all of which fall within the true spirit and scope of the invention. Although AR15/10 and/or M16/M4 rifle platforms have been disclosed, the firearm sight system is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm sight system comprising:

an elongated mounting rail including a plurality of transverse bars separated by intervening transverse mounting location channels extending from a rearmost channel to a forwardmost channel;

the elongated mounting rail having an elongated upper surface;

the elongated mounting rail defining a pocket below the elongated upper surface and at least in part forward of the rearmost channel;

a sight assembly connected to the elongated mounting rail;

the sight assembly including a fixed portion inside the pocket and fixed to the elongated mountain rail and an arm portion pivotally connected to the fixed portion and movable between an elevated position angularly offset from the elongated upper surface of the elongated mounting rail and a stowed position in which the sight arm occupies the pocket; and the first portion defining a sight channel shaped complementary to a selected one of the channels of the elongated mounting rail and registered therewith.

2. The firearm sight system of claim 1 wherein at least a forward portion of the sight assembly is entirely below the elongated upper surface of the elongated mounting rail when in the stowed position.

3. The firearm sight system of claim 1 wherein the entire sight assembly is entirely below the elongated upper surface of the elongated mounting rail when in the stowed position.

4. The firearm sight system of claim 1 wherein the sight assembly pivots on a pivot axis below the elongated upper surface of the elongated mounting rail, and wherein the pivot axis is forward of the rearmost channel.

5. The firearm sight system of claim 1 wherein the elongated mounting rail has a rail width defined between opposed left and right lateral rail edges, and wherein the sight assembly has an arm width less than the rail width.

6. The firearm sight system of claim 1 wherein the entire sight assembly is forward of a rear end of the elongated mounting rail.

7. The firearm sight system of claim 1 wherein the pocket encompasses the sight assembly sides and rear when stowed.

8. The firearm sight system of claim 1 wherein the pocket defines a forward neck portion having a first width and a rearward head portion having a greater width.

9. The firearm sight system of claim 1 wherein the sight assembly defines a first sight aperture, and including a pivoting aperture element with a second smaller aperture, the pivoting aperture element movable between a first position in which it registers with the first sight aperture to provide a reduce diameter sight, and a second position away from the first sight aperture, and the sight assembly including a magnet to movably secure the pivoting aperture element to the sight assembly in at least one of the first and second positions.

10. A firearm comprising:

a frame including an elongated mounting rail including a plurality of transverse bars separated by intervening transverse mounting location channels extending from a rearmost channel to a forwardmost channel;

a barrel mounted to the frame and defining a barrel axis;

the elongated mounting rail having an elongated upper surface;

the elongated mounting rail defining a pocket below the elongated upper surface and at least in part forward of the rearmost channel; and a sight assembly connected to the elongated mounting rail;

the sight assembly including a fixed portion inside the pocket and fixed to the elongated mountain rail and an arm portion pivotally connected to the fixed portion and movable between an elevated position angularly offset from the elongated upper surface of the elongated mounting rail and a stowed position in which the sight assembly occupies the pocket; and the fixed portion defining a sight channel shaped complementary to a selected one of the channels of the elongated mountain rail and registered therewith.

11. The firearm of claim 10 wherein at least a forward portion of the sight assembly is entirely below the elongated upper surface of the elongated mounting rail when in the stowed position.

12. The firearm of claim 10 wherein the entire sight assembly is entirely below the elongated upper surface of the elongated mounting rail when in the stowed position.

13. The firearm of claim 10 wherein the sight assembly pivots on a pivot axis below the elongated upper surface of the elongated mounting rail, and wherein the pivot axis is forward of the rearmost channel.

14. The firearm of claim 10 wherein the elongated mounting rail has a rail width defined between opposed left and right lateral rail edges, and wherein the sight assembly has an arm width less than the rail width.

15. The firearm of claim 10 wherein the entire sight assembly is forward of a rear end of the elongated mounting rail.

16. The firearm of claim 10 wherein the pocket encompasses the sight assembly sides and rear when stowed.

17. The firearm of claim 10 wherein the pocket defines a forward neck portion having a first width and a rearward head portion having a greater width.

18. The firearm of claim 10 wherein the sight assembly defines a first sight aperture, and including a pivoting aperture element with a second smaller aperture, the pivoting aperture element movable between a first position in which it registers with the first sight aperture to provide a reduce diameter sight, and a second position away from the first sight aperture, and the sight assembly including a magnet to movably secure the pivoting aperture element to the sight assembly in at least one of the first and second positions.

19. The firearm of claim 10 wherein the sight assembly defines a first sight aperture defining a sight axis when in the elevated position at least 2.5 inches above the barrel axis.

20. The firearm of claim 19 wherein the sight axis is 2.6 inches above the barrel axis.

21. The firearm sight system of claim 1 wherein the pocket is enclosed at forward and rear ends.

22. The firearm sight system of claim 1 wherein the fixed portion defines a transverse mounting pin hole adjacent to the sight channel and registered with a transverse bar of the elongated mounting rail.

23. The firearm of claim 10 wherein the pocket is enclosed at forward and rear ends.

24. The firearm of claim 10 wherein the fixed portion defines a transverse mounting pin hole adjacent to the sight channel and registered with a transverse bar of the elongated mounting rail.

* * * * *